US006561102B1

(12) United States Patent
Wang

(10) Patent No.: US 6,561,102 B1
(45) Date of Patent: May 13, 2003

(54) FLOATABLE FIREWORK DEVICE

(76) Inventor: Chieh-Yih Wang, No. 179-1, Liu-Tze-Lin, Liu-Hsiang Tsun, Shui-Shang Hsiang, Chia-I Hsien (TW)

( * ) Notice: Subject to any disclaimer, the term of this patent is extended or adjusted under 35 U.S.C. 154(b) by 0 days.

(21) Appl. No.: 10/091,005

(22) Filed: Mar. 4, 2002

(51) Int. Cl.[7] ..... F42B 4/00
(52) U.S. Cl. ..... 102/358
(58) Field of Search ..... 102/341, 361

(56) References Cited

U.S. PATENT DOCUMENTS 825,419 A * 7/1906 Rose ..... 102/341
2,331,439 A * 10/1943 Thiebault ..... 102/341
2,736,044 A * 2/1956 Lewis ..... 102/341
3,060,854 A * 10/1962 Maretti ..... 102/352
3,762,327 A * 10/1973 Murray et al. ..... 102/341
3,954,059 A * 5/1976 Langseth ..... 102/343
4,069,762 A * 1/1978 Maury ..... 102/341
6,230,629 B1 * 5/2001 Doctor et al. ..... 102/337

FOREIGN PATENT DOCUMENTS

CA 1121609 * 6/1980 ..... 102/341

* cited by examiner

*Primary Examiner*—Peter A. Nelson
(74) *Attorney, Agent, or Firm*—Timothy J. Keefer; Wildman, Harrold, Allen & Dixon

(57) ABSTRACT

A floatable firework device includes a hollow base for fitting an explosive therein, a waterproof fuse, and a tubular buoyancy member sleeved fixedly around an upper portion of the base. The base has a center of gravity at a lower end portion thereof. As such, the firework device can float on a water surface, with a flame-spraying upper end slit in the base being disposed above the water surface.

7 Claims, 3 Drawing Sheets

FLOATABLE FIREWORK DEVICE

BACKGROUND OF THE INVENTION

1. Field of the Invention

This invention relates to a firework device, and more particularly to a floatable firework device.

2. Description of the Related Art

Fireworks are used in the evening, and produce light, smoke, and noise for providing a festive mood. Conventional fireworks are hung or are placed on the ground, and are not designed to float on a water surface.

SUMMARY OF THE INVENTION

The object of this invention is to provide a floatable firework device.

According to this invention, a floatable firework device includes a hollow base for fitting an explosive therein, a waterproof fuse, and a tubular buoyancy member sleeved fixedly around an upper portion of the base. The base has a center of gravity at a lower end portion thereof. As such, the firework device can float on a water surface, with a flame-spraying upper end slit in the base being disposed above the water surface.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
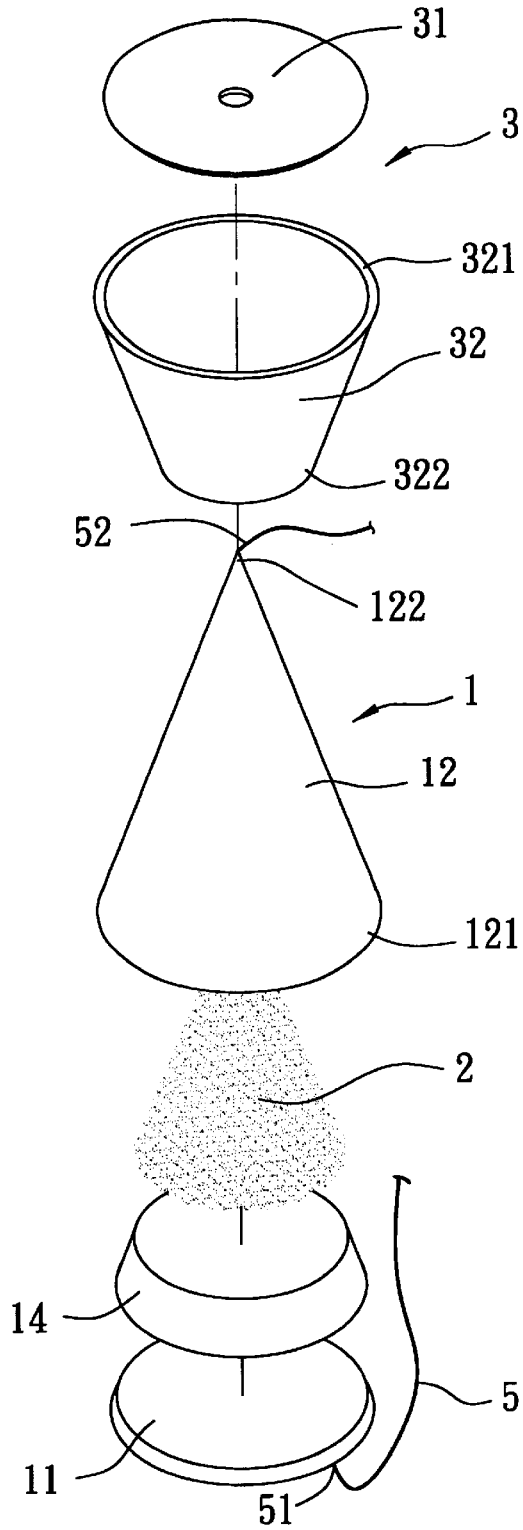
FIG. 1 is an exploded perspective view showing the preferred embodiment of a floatable firework device according to this invention.
Figure 2:
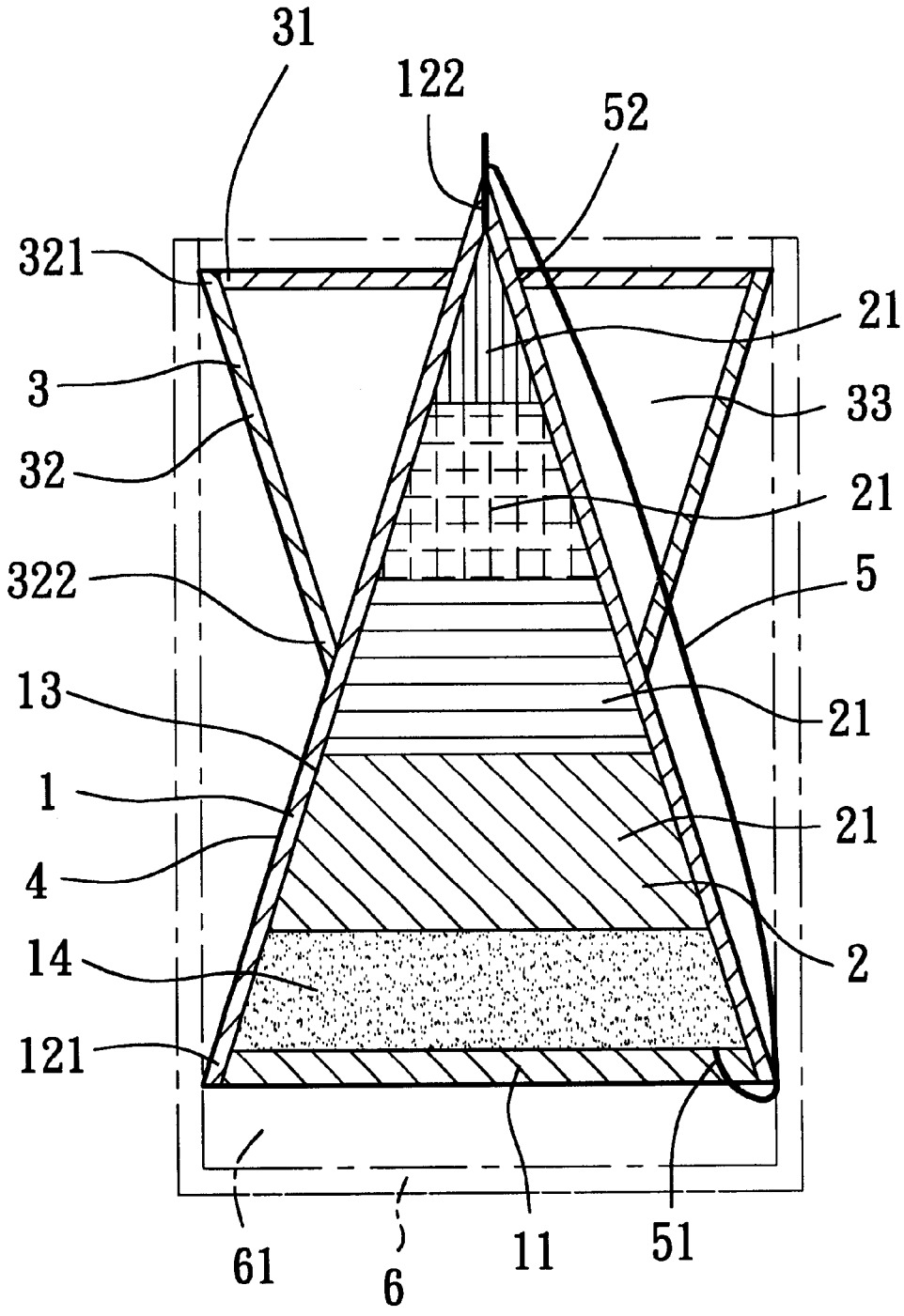
FIG. 2 is a sectional view of the preferred embodiment, illustrating how the preferred embodiment is disposed within a launching tube.
Figure 3:
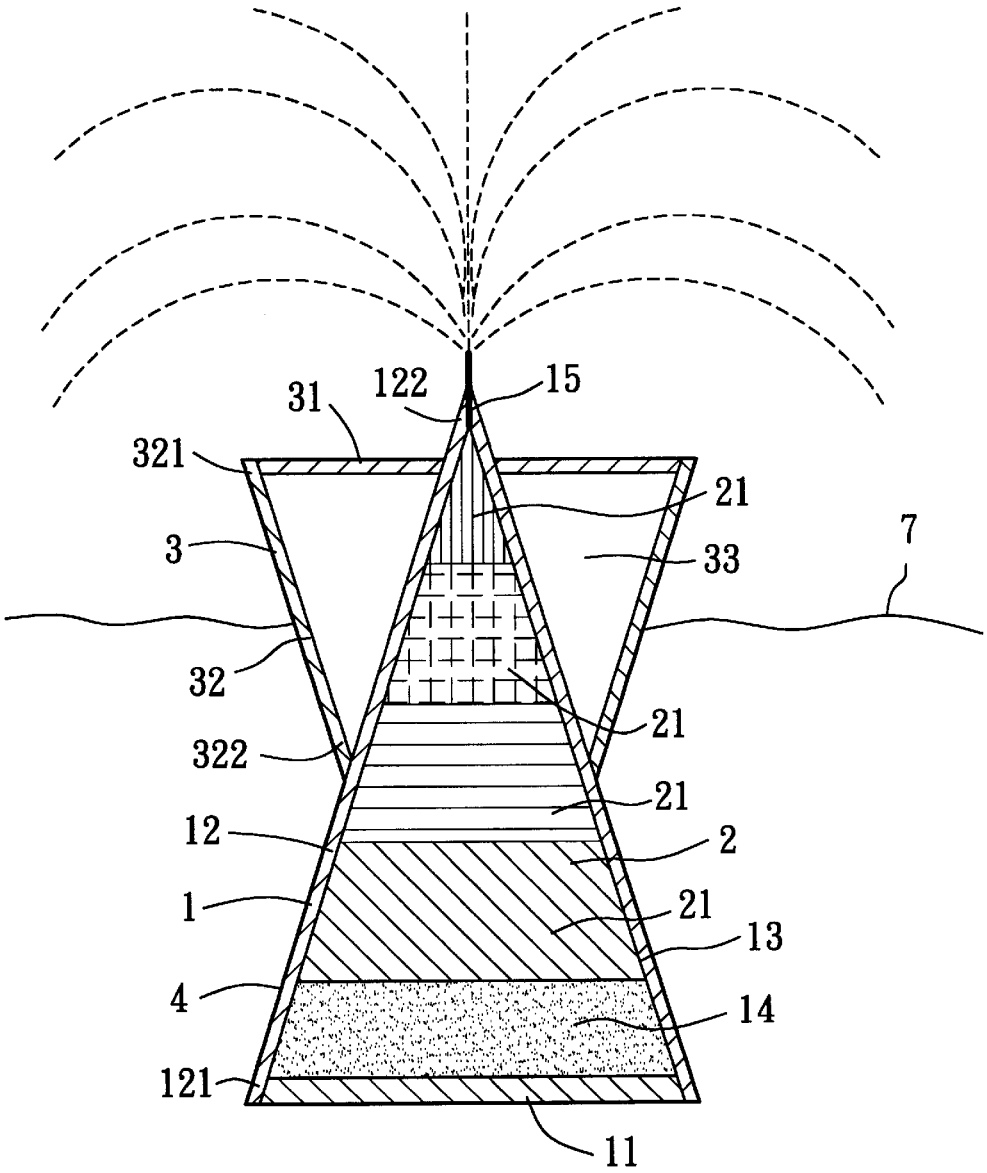
FIG. 3 is a sectional view of the preferred embodiment, illustrating how the preferred embodiment floats on a water surface.

Referring to FIGS. 1, 2, and 3, the preferred embodiment of a floatable firework device according to this invention is shown to include a hollow base 1, an explosive unit 2, a buoyancy member 3, a waterproof film 4, and a waterproof fuse 5.

The hollow base 1 has a generally horizontal, circular bottom wall 11 and a conical surrounding wall 12 that are made of paperboards. The surrounding wall 12 has a lower end 121 that is adhered to an outer periphery of the bottom wall 11, and an upper end tip 122. An accommodation chamber 13 is defined between the bottom wall 1 and the surrounding wall 12. A counterweight unit 14 is clamped between the bottom wall 11 and the explosive unit 2 so that the center of the gravity of the device is located adjacent to a lower end of the base 1. The counterweight unit 14 is configured as a lump of iron powders, which can be replaced with a lump of sandy soil. Alternatively, the bottom wall 11 can be thickened so as to lower the center of gravity of the device, thereby serving as a counterweight unit. A flame-spraying upper end slit 15 is formed in an upper end of the base 1, and is communicated with the accommodation chamber 13.

The explosive unit 2 is fitted within the accommodation chamber 13 in the base 1, and includes a plurality of explosive layers 21, which are arranged on above another and which have different colors that are respectively red, yellow, blue, and green from the top to the bottom. The colors and the arrangement order thereof can be changed.

The buoyancy member 3 is tubular, and includes a ring-shaped top wall 31 that is adhered around the base 1, and a surrounding wall 32 that is adhered to an outer periphery of the top wall 31 at an upper end 321 thereof and that reduces downwardly and gradually in diameter. The surrounding wall 32 has a lower end 322 that is adhered around the base 1 so as to define a sealed air chamber 33 between the buoyancy member 3 and the base 1. As such, the base 1 can float on a water surface 7 (see FIG. 3) in such a manner that the upper end slit 15 is disposed above the water surface 7. The top wall 31 and the bottom wall 11 have an outer diameter that is equal to the inner diameter of a launching tube 6. That is to say, the base 1 has a maximum outer diameter which is equal to that of the buoyancy member 3. Accordingly, the firework device can be positioned within the tube 6 such that the firework device can be launched from the tube 6 in a longitudinal direction of the tube 6 upon combustion of an explosive charge 61 in the tube 6, as shown in FIG. 2.

The fuse 5 has a lower end 51 that extends into and that is fixed within a hole in a bottom surface of the bottom wall 11 of the base 1, and an upper end 52 that extends through the upper end slit 15 in the base 1 and into the accommodation chamber 13 and that is disposed adjacent to an upper end of the explosive unit 2.

The film 4 is coated on an outer surface of an assembly of the base 1 and the buoyancy member 3 by spraying or immersion after assembling the buoyancy member 3 on the base 1. Alternatively, the film 4 can be coated respectively on outer surfaces of the base 1 and the buoyancy member 3 prior to assembling the buoyancy member 3 on the base 1.

With this invention thus explained, it is apparent that numerous modifications and variations can be made without departing the scope and spirit of this invention. It is therefore intended that this invention be limited only as indicated by the appended claims.

I claim:

1. A floatable firework device comprising:

a hollow base defining an accommodation chamber therein and having a center of gravity at a lower end portion thereof, a closed lower end, and a flame-spraying upper end slit that is communicated with said accommodation chamber;

an explosive unit fitted within said accommodation chamber;

a tubular buoyancy member sleeved fixedly around an upper portion of said base so as to be adapted to permit floating of said base on a water surface; and a waterproof fuse having a lower end that is attached to said lower end of said base, and an upper end that extends through said upper end slit in said base and into said accommodation chamber in said base and that is disposed adjacent to said explosive unit.

2. The floatable firework device as claimed in claim 1, wherein said base includes a generally horizontal bottom wall, and a conical surrounding wall which has an upper end tip and a lower end that is connected fixedly to an outer periphery of said bottom wall.

3. The floatable firework device as claimed in claim 2, wherein said buoyancy member includes a ring-shaped top wall that is sleeved fixedly on said base, and a surrounding wall that is connected fixedly to an outer periphery of said top wall at an upper end thereof and that reduces downwardly and gradually in diameter, said surrounding wall of said buoyancy member having a lower end that is sleeved fixedly on said base so as to define a sealed air chamber between said buoyancy member and said base.

4. The floatable firework device as claimed in claim 2, further comprising a counterweight unit, which is attached to said bottom wall of said base and which is disposed under said explosive unit so as to increase weight of said lower end portion of said base.

5. The floatable firework device as claimed in claim 1, further comprising a waterproof film coated on an outer surface of an assembly of said base and said buoyancy member.

6. The floatable firework device as claimed in claim 1, wherein said explosive unit includes a plurality of explosive layers, which are arranged one above another and which have different colors.

7. The floatable firework device as claimed in claim 1, wherein said base has a maximum outer diameter which is approximate to that of said buoyancy member.

* * * * *